US005934041A

United States Patent [19]

Rudolf et al.

[11] Patent Number: 5,934,041

[45] Date of Patent: Aug. 10, 1999

[54] APPARATUS FOR PACKAGING OF MATTRESSES

[75] Inventors: Erich Rudolf, Heiligkreuzsteinach; Axel Stoll, Hohen-Suelzen, both of Germany

[73] Assignee: Fillmatic Polsterindustrie Maschinen GmbH, Mannheim, Germany

[21] Appl. No.: 08/899,310

[22] Filed: Jul. 23, 1997

[30] Foreign Application Priority Data

Jul. 23, 1996 [DE] Germany ..... 196 29 606

[51] Int. Cl.[6] ..... B65B 63/04

[52] U.S. Cl. ..... 53/118; 53/116; 53/529

[58] Field of Search ..... 53/116, 118, 119, 53/528, 529, 530

[56] References Cited

U.S. PATENT DOCUMENTS

| | | | |
|---|---|---|---|
| 3,013,367 | 12/1961 | Sarre | 53/118 X |
| 3,052,073 | 9/1962 | Johansen et al. | 53/118 |
| 3,509,685 | 5/1970 | Sykes | 53/55 |
| 3,658,273 | 4/1972 | Chapuis | 53/118 X |
| 3,671,033 | 6/1972 | Coast | 53/118 X |
| 3,964,232 | 6/1976 | Bender et al. | 53/118 X |
| 4,245,829 | 1/1981 | Coast | 53/118 X |
| 4,291,460 | 9/1981 | Stoehr | 53/118 X |
| 4,711,067 | 12/1987 | Magni | 53/439 |
| 5,177,935 | 1/1993 | Jones et al. | 53/529 X |

*Primary Examiner*—Daniel B. Moon
*Attorney, Agent, or Firm*—Anderson, Kill & Olick, P.C.

[57] ABSTRACT

An apparatus for packaging mattresses and including a furling drum having a roll-forming chamber defined by a plurality of circumferentially arranged rotatable rollers located downstream of a substantially nozzle-shaped feeding area of the drum, with the rollers having a surface pattern defined by a plurality of circumferentially spaced from each other mattress-engaging elements providing for rolling of a mattress into a roll and enabling movement of the mattress in an axial direction; and a forming tube provided downstream of the furling drum for wrapping the rolled mattress, with the forming tube having a diameter greater than a diameter of the furling drum.

9 Claims, 8 Drawing Sheets

APPARATUS FOR PACKAGING OF MATTRESSES

BACKGROUND OF THE INVENTION

1. Field of the Invention

The present invention relates to an apparatus for packaging mattresses which includes a furling drum in which the mattresses are formed into rolls and which has a plurality of circumferentially by arranged rotatable rollers arranged downstream of a nozzle-type feeding area and defining a forming chambers, and a forming tube in which the rolled mattresses are placed into a sack, a bag or any other wrapping.

2. Description of the Prior Art

For transportation purposes, mattresses are formed into rolls and wrapped using, to this effect, different known devices and procedures.

These procedures and devices take into account, as a rule, the type of mattress to be treated, e.g. thin cushions, full-foam mattresses or campbeds.

Thin cushions are made of soft foam stuffed in a fabric case. Generally, the soft foam is sewn in or the fabric case is equipped with a mounting zip. The foam has a maximum thickness of 8 cm. Devices used for the treatment of thin cushions, generally used as campbeds, are unsuited for the processing of mattresses having a thickness of 10 cm and above. Devices used for the processing of thin cushions include a feeder belt receiving the cushion to be processes and conveying it towards the inlet of a sheet-metal drum where it is furled. The cushion, in order to enable nonskid conveyance, is passed through two contrarotating rollers which, similar to the rollers of a calendar, force the cushion into a subsequent sheet-metal channel the special shape of which compels the cushion to get wrapped round on itself. Not much of a compression is applied onto the cushion during the furling phase, because the design of the system does not enable the transmission of elevated forces and because the cushion is supposed to glide along the metal-sheet wall of the drum. Upon completion of the furling process, when the cushion is completely wrapped round on itself, it is expelled from the drum in the axial direction by a slider. The drum opens into a socket with a tubular film with hot-seal cross beam being slipped over it in such a way as to enable the cushion, upon discharge from the socket, to be introduced into the film bag. The disadvantage of this procedure consists in that no significant reduction of volume can be achieved, due to the design of the system that does not enable a strong compression to be applied during the furling process. This type of machine merely enables the bulky cushion to be rolled up into a compact roll which, once placed in its wrapping, will be easy to handle.

There are also devices that are suited for the packaging of full-foam mattresses made of soft-foam pads stuffed in a plain fabric case or in a case composed of two quilt-fabric plates connected one with another by means of a so-called border or mattress bottom. This type of mattress usually has joining seams all along the circumference of the quilt-fabric plates protected by a welting attachment. The minimum thickness is 10 cm, up to as much as 16 cm in quality products. Foam densities are in the range of up to 35 kg/m$^3$, at a compression hardness up to 50 (processing method from 1.3 to 1.5).

This type of mattresses can be treated by vacuum packaging. At first, the mattress is fed in its full size into a film packaging machine where it is hermetically sealed in a plastic film. After this, it is placed under a flattening press the compression board of which is connected by a hose to a vacuum pump. The packaging film is cut open precisely where the opening of the vacuum hose rests against the plastic film sheathing, to enable the creation of a vacuum. Pressure is now applied to the press which, as a vacuum is created, compresses the mattress down to a thickness between 1 and 3 cm, at a cycle length of some minutes.

When the desired compression is attained, an operating person activates a signal to release pressure. As the compression board returns to its upper home position, the slot previously applied to the plastic film sheath with a view to enabling the air to be sucked off is quickly sealed again by means of an adhesive tape while the mattress, under the effect of atmospheric pressure, remains in its compressed state. After this, the flat mattress is rolled up and placed in a tubular film bag. In the course of time, while the system is frequently not one hundred per cent hermetical, the mattress will continuously expand until it occupies all the space available inside the tubular film bag. The plastic film bag is sealed by means of adhesive tape, wire or by hot-sealing means. The considerable disadvantages of these procedures and devices consist in that they are highly labour-intensive and time-consuming. The film consumption for a 2-meter mattress is 5 meters plus the tubular film bag. After stuffing the material into the fabric case in the filling machine, a second work cycle is required in the film packaging machine to subsequently hot-seal the mattress in a plastic film wrapping.

Furthermore, the known state of the art includes different types of mattress furling machines. Most of these are based upon on the principle adopted for the box-spring mattress furl-packaging machines. These devices have a centre mandrel and one or more pressure rollers. The mattress, together with one end of a long strip of film, are fed into the machine passing them through the gap defined by the mandrel and the pressure roller. In some embodiments, the film is coiled onto the mandrel before introducing the mattress in order to avoid the latter to get into direct contact with the mandrel. The mattress is flattened by the pressure applied by both the pressure rollers and the mandrel as the mattress and the plastic film are coiled in several layers close around the mandrel. In this process, the mandrel pulls the bottom side while it rotates, with the upper side being squeezed and flattened in one direction. As a result thereof, the joining fabric between the two quilted plates forming the upper and the bottom sides of the mattress is subjected to considerable strain. When the mattress is completely drawn in, strips of adhesive tape are applied at several points onto the plastic film which are rolled up with the mattress as coiling continues. After this, the plastic film is cut off and coiling continues over a given length of adhesive tape, without any plastic film, before the strips of adhesive tape are cut off as well. This produces an extremely tight coil, composed of the mattress and the plastic film, furled in several turns around the mandrel and wrapped on the outside with adhesive tape. Upon completion of the coiling process, the mandrel is withdrawn from the centre of the coil, either by retracting it into a stripping wall or by means of a stripper designed to push the mattress roll laterally off the mandrel. Once stripped off the mandrel, the mattress will undergo an expansion in the direction of its centre. All there remains to do, is to seal the mattress roll on both sides by means of adhesive tape or a cord or by hot-sealing.

The great disadvantage of these devices are to be seen in an extremely elevated film consumption of up to 7 meters per mattress. In addition, the mattress undergoes an extreme compressive strain due to the confined space conditions prevailing inside the compression compartment of a given outer perimeter and with the thick mandrel in its centre. It is due to the afore-mentioned specific properties of the device that lots of packaging material are wasted or that the mattress may be damaged while withdrawing the centre mandrel or soiled by the hydraulic oil necessary to keep the moving parts of the mandrel operative. Sealing the mattress roll with adhesive tape, if automatable at all, is a highly delicate pocedure known to give rise to frequent system failures or breakdowns. It is not possible, as a matter of fact, to conceive a sort of workflow that could be integrated into the work cycle of a semiautomated processing line, due to the fact that each mattress needs to be fed into the gap defined by the pressure rollers and the centre mandrel. The handling time being two to five minutes per mattress, this system offers a very poor productivity.

Other mattress-furling machines have been disclosed which do not use a centre mandrel. Instead, these devices include a superstructure composed of driven rollers defining two semicircles. The rollers are supported in a fulcrum at each end of the semicircle, whereas the free end of each semicircle can be moved in a sort of pincers movement by a power drive, most often pneumatic lock cylinders, to form either a closed or an open drum. The mattress, together with one end of a long piece of plastic film, are introduced in between the end rollers of the open semidrum. The mattress and the plastic film, are flattened, under the pressure exerted by the lock cylinder, between the end rollers and, upon activation of the drive, thrust into the roller drum, where they are guided by the driven roller drums and rolled up. When the mattress is completely drawn in, strips of adhesive tape are applied onto it which are rolled up with the mattress as coiling continues. After this, the plastic film is cut off and coiling continues over a given length of adhesive tape, without any plastic film, before the strips of adhesive tape are cut off as well.

Another variant consists in that a glue is sprayed onto the cutting edge of the plastic-film excess length, said cutting edge being defined by a line parallel to the drum axis, with said cutting edge being sealed by the glue as coiling continues.

Depending on the machine design, the mattress furled into a roll may be simply dropped or removed by hand as the half-shell opens under the action of the lock cylinder. After this, the mattress roll will be be sealed on both sides by means of adhesive tape or by hot-sealing.

There are quite some disadvantages to this procedure as well. Plastic-film consumption is relatively high. The mattress undergoes a more or less intensive torsion affecting the area between the upper and lower plate of the quilted fabric case. While the mattress is prevented from expanding again after the furling process, this will inevitably result in the formation of creasing of the woven drill. Again, sealing with adhesive tape is a rather delicate procedure that would frequently lead to failure or breakdown and that can hardly be automated, unless glue were sprayed onto the plastic-film cutting edge. Furthermore, there is no possibility to have the workflow hereinbefore referred to integrated into the work cycle of a semiautomated processing line, due to the fact that each mattress needs to be fed into the gap defined by the end rollers of the drum half-shells.

It is therefore an object of the present invention to provide an improved device of the above-mentioned type, with a view to having the volume of the mattress reduced by compression for the ease of transport, as well as to arriving at an automated furling process and at the

SUMMARY OF THE INVENTION

The objects of the present invention are achieved by providing, in the furling drum, means for axially discharging the mattresses and which is formed by respective patterns on the roller surfaces.

The present invention enables the volume of finished foamed-plastics mattresses to be reduced for the ease of transport by furling them into a handy roll. The mattresses to be packaged can be fed into the machine fully automatically, without intervention whatsoever, e.g. from a conveyor belt. To avoid the high cost of disposal and the great amounts of plastic-film wastes produced, the present invention suggests the mattress to be placed in a plastic-film bag only after it was completely furled into a roll. More precisely, the present invention suggests a device for the packaging of mattresses in which the mattresses are introduced, under compression, into a furling drum, where they are formed into rolls, then discharged into a forming tube at the far end of which they are compelled into a sack, a bag or wrapping. The furling drum is defined by a multitude of downstream—with regard to a nozzle type feeding area—rotating rollers arranged in a circular configuration to form a forming chamber. While the cadence of the furling area is synchronous with the relatively quick cadence of the feeding area, there is no longer any need for the intercalation of a buffer zone. The mattress is passed, under compression, through the nozzle-type feeding area into the furling drum.

The present invention suggests, with a view to enabling a given degree of compression and to carrying along the mattresses by the action of the rollers of the furling drum thus furling them into a roll, that means be provided inside the furling drum which, for the purpose of rolling the mattresses up, enable not only a frictional connection with the mattresses to be rolled up but also an unimpeded axial discharge of the mattresses into the subsequent forming tube, thus enabling the speed of the downstream packaging process to be adapted to the one of the upstream mattress furling process.

The present invention provides different embodiments by which said means can be complied with.

In a first particularly preferred embodiment of the present invention, it is suggested that the rollers be equipped with a sectional pattern enabling a safe frictional connection of the rollers with the mattress, said sectional pattern being designed in such a way as to provide—in the axial direction, i.e. in the direction in which the mattress is expelled into the forming tube—a frictionally neutral moulding action enabling an unimpeded sliding movement of the mattress. This is achieved preferably by a sectional pattern on the roller surface defined by raised webs extending continuously at least over a given portion of the roller length. Said webs may be of an approximately square, rectangular or circular cross section. The gaps between the webs form a sort of toothing enabling a safe grip on the mattress. Under the rotational and compressive effects, the frictional forces acting upon the mattress are absolutely optimal, thus maintaining the compressive effect during the rotation of the mattress until a finished mattress roll is obtained, whereas no such frictional connection exists while the finished mattress roll is expelled axially, i.e. while sliding along the webs.

Another embodiment of the present invention consists in that at least one roller provides a roller surface enabling a frictional connection with the mattress both in the sense of rotation and in the axial direction. For an axial expulsion of the mattress, said roller is disengaged by a tilting or swiveling movement, with a substitute being inserted in lieu thereof preventing any loss of compression onto the mattress while the roller is in the disengaged position.

The roller surface may be covered with a rubber coating or the uncovered roller body may have a roughened surface.

Still another embodiment of the present invention consists in that a sectional pattern is applied to the roller surfaces, for example, that extends over part of the circumference only, in such a way as to form a sector of a frictionally neutral area. If the mattress were to be expelled in an axial direction, the stoppage of the rollers shall be controlled in a way as to ensure the frictionally neutral sectors pointing at the mattresses.

Using the device, the object of the present invention, while the rolled-up mattress is put into a film bag only upon completion of the furling cycle, there is no longer any need for a plastic film to be carried along with the mattress all along the furling process, thus avoiding unnecessary film consumption and a waste of plastic-film material thereafter. As a result of this, the workflow is straightway accelerated and the number of operating personnel reduced. A mattress filling machine, in a production line typically directly preceding the mattress furling station, has a work cycle between 20 seconds and 1 minute, whereas about 30 seconds per mattress, or about 1 minute in the case of an absolutely plain equipment without options, are realistic in a mechanised production. This is why the mattresses, in all hitherto known procedures, had to be stored away in an intermediate storage area following the filling station resulting not only in additional space requirements but also in additional labour necessary for an intermediate stockpiling and handling of the filled mattresses prior to their being processed in the furling machine. The acceleration obtained when the device, the object of the present invention, is used enables the furling machine to be fully integrated in a production line and represents a considerable rationalisation potential.

Furthermore, the present invention helps to reduce the formation of creases. Unlike the traditional packaging procedures, in which the mattresses, upon unpacking, are affected by creases due to the tendency of the quilted drill to creasing under compression, this adverse affect can be reduced by the use of the device suggested by the present invention. This is achieved in that the rolled-up mattress, once placed in the plastic-film bag, is allowed to expand, thanks to a compression behaviour contrary to that known from the existing state of the art: The mattress to be packaged undergoes maximum compression in the furling cage, reduced compression in the forming tube and a progressively fading compression in the plastic-film bag, thanks to the possibility of expansion therein.

BRIEF DESCRIPTION OF THE DRAWINGS

The features and objects of the present invention will become more apparent, and the invention itself will be best understood from the following detailed description of the preferred embodiment when read with reference to the accompanying drawings, wherein.

Figure 1:
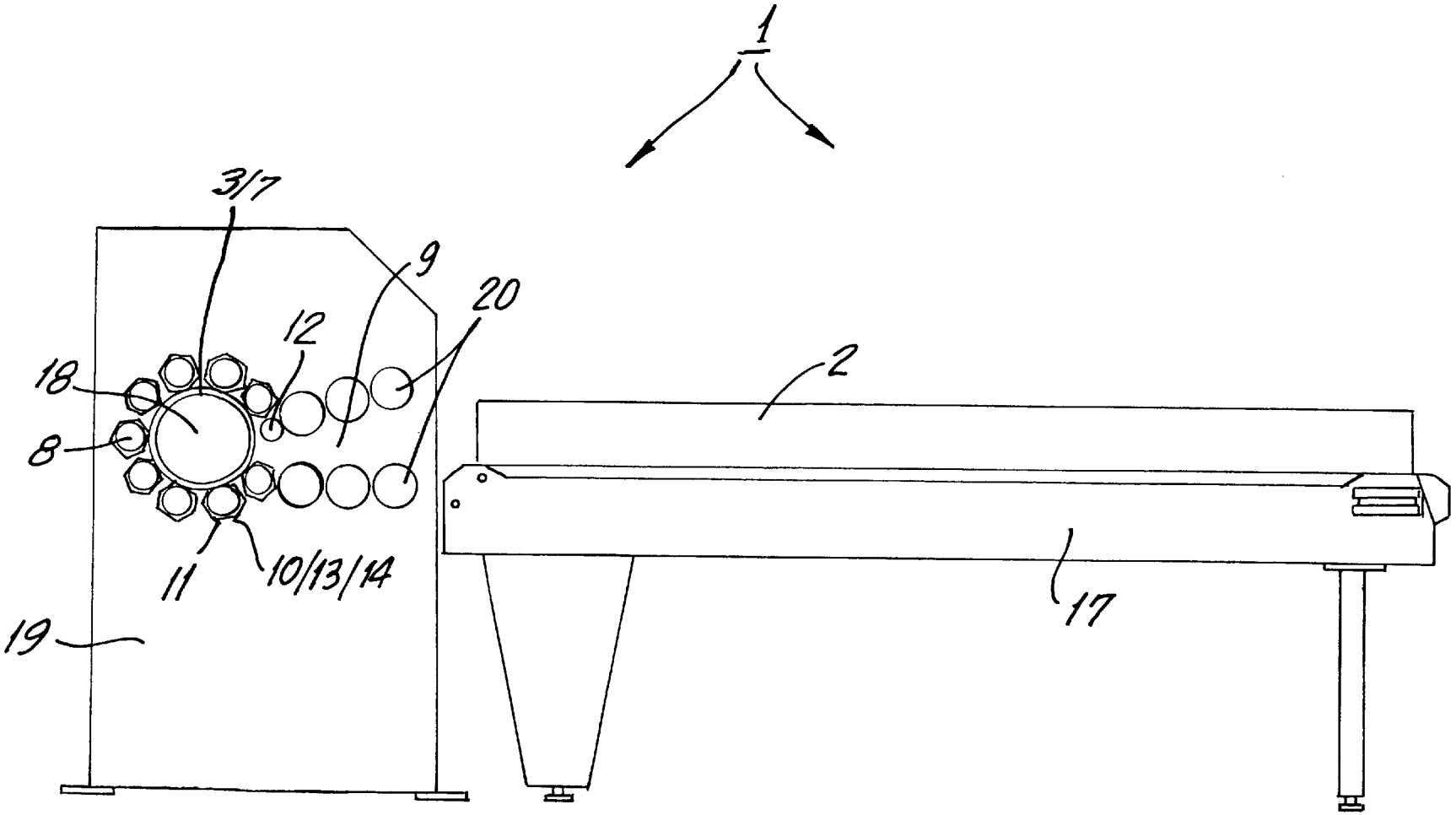
FIG. 1 is a sectional view of the present invention, wherein the furling drum is shown in cross-section.

The packaging cycle will be described more fully hereinafter, with reference to drawings 1 and 2 at first.

The device as such is identified by reference number (1). The mattress (2) is either placed on a feeding belt (17) along an aligning bar or delivered by an upstream conveying belt.

The feeding belt (17) is started by actuating a foot switch and begins to push the mattress (2), through a charging zone (9) defined by a nozzle-type compression roller system, into the furling drum (3). Inside the furling drum (3), the mattress (2), previously compressed in the nozzle-type charging zone (9), passes along and past the non-driven roller (22) and is forced into a circular movement by the action of the driven rollers (8), thus being coiled to form a compact roll. Upon completion of the coiling process, the drive will stop and a thrust plate (18) expels the mattress (2) axially at the far end of the furling drum (3). On this side there is a forming tube (4) which constitutes an axial extension of the furling drum (3), with a sack, bag or wrapping (6) being slipped over it (see FIG. 3). As a matter of fact, a sort of forming chamber (7) is defined by the rollers (8) mounted in the furling drum (3).

The finished mattress roll (2) is discharged laterally into a plastic-film tube, sack, bag or wrapping (6) (see FIG. 3) where it may expand into the shape of a taut and non-creasing roll. The machine can be integrated in a production line where it is adjusted to exactly the cadence of the filling process, as the next mattress (2) can be fed into the machine from the feeding belt (17) as soon as the furling cycle of the preceding one is completed. The cycle length is about 30 seconds, on the condition that the mattresses to be furled (2) need not be put in place by the operator but that they be continuously delivered by an appropriate conveying system.

The device (1) is composed of a head frame (19) and the feeding belt (17). The head frame (19) houses the driven rollers (8) arranged in the form of a drum. The furling drum (3) opens to one side (mattress intake) in that there is a 1-roller discontinuance in the circular row of rollers. Before it, upstream, there is the charging zone (9) defined by a set of intake rollers (20) arranged in a nozzle-type configuration. In the centre of the furling drum (3), there is a thrust plate (18) designed to push the finished mattress roll (2) laterally into the forming tube (4) the centre axis (21) of which defines the extension of the geometric axis of the roller drum. The finished mattress roll (2) is expelled by the expulsion slider, or thrust plate (18) respectively, directly into the forming tube (4), with the slipped-over wrapping (6) being stripped from the forming tube (4) as the mattress roll (2) is forced into the wrapping (6). The device is equipped with controls enabling automatic monitoring of the work cycle, from the moment the mattress (2) is fed into the furling drum (3) until it is completely coiled into a finished roll. At this moment, the control system stops the machine which remains inactive awaiting the operator's signal (foot switch) by which the presence of a plastic-film wrapping (6) on the forming tube (4) is confirmed. The control system, upon reception of said signal and with the roller drive being arrested, actuates the motor of the expulsion mechanism. Once the mattress is expelled into the plastic-film wrapping (6), the one open end of the plastic-film wrapping (6) is sealed by means of a twisted wire staple or an adhesive tape. The finished parcel may then be placed in a cardboard box.

Figure 2:
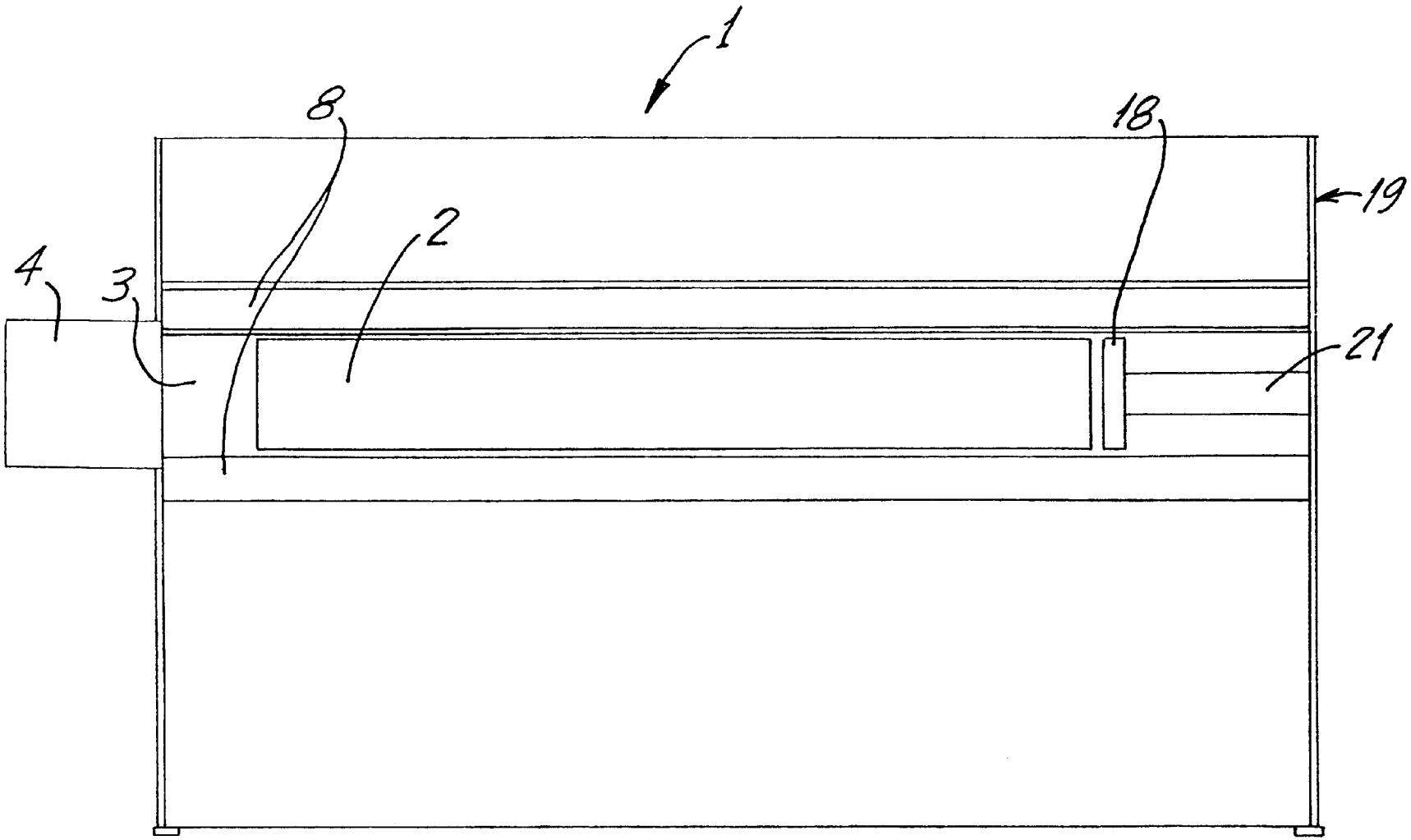
FIGS. 2–4 provide a view of the present device and of the subsequent forming tube, with different positions of the thrust plate.

FIG. 2 shows the head-frame (19) portion of the device (1), object of the present invention. The mattress (2) is in the furling drum (3) and the thrust plate (18) assumes its home position. This Figure illustrate the mattress (2) being subjected to the forming process while the thrust plate (18) remains in the disengaged position.

Figure 3:
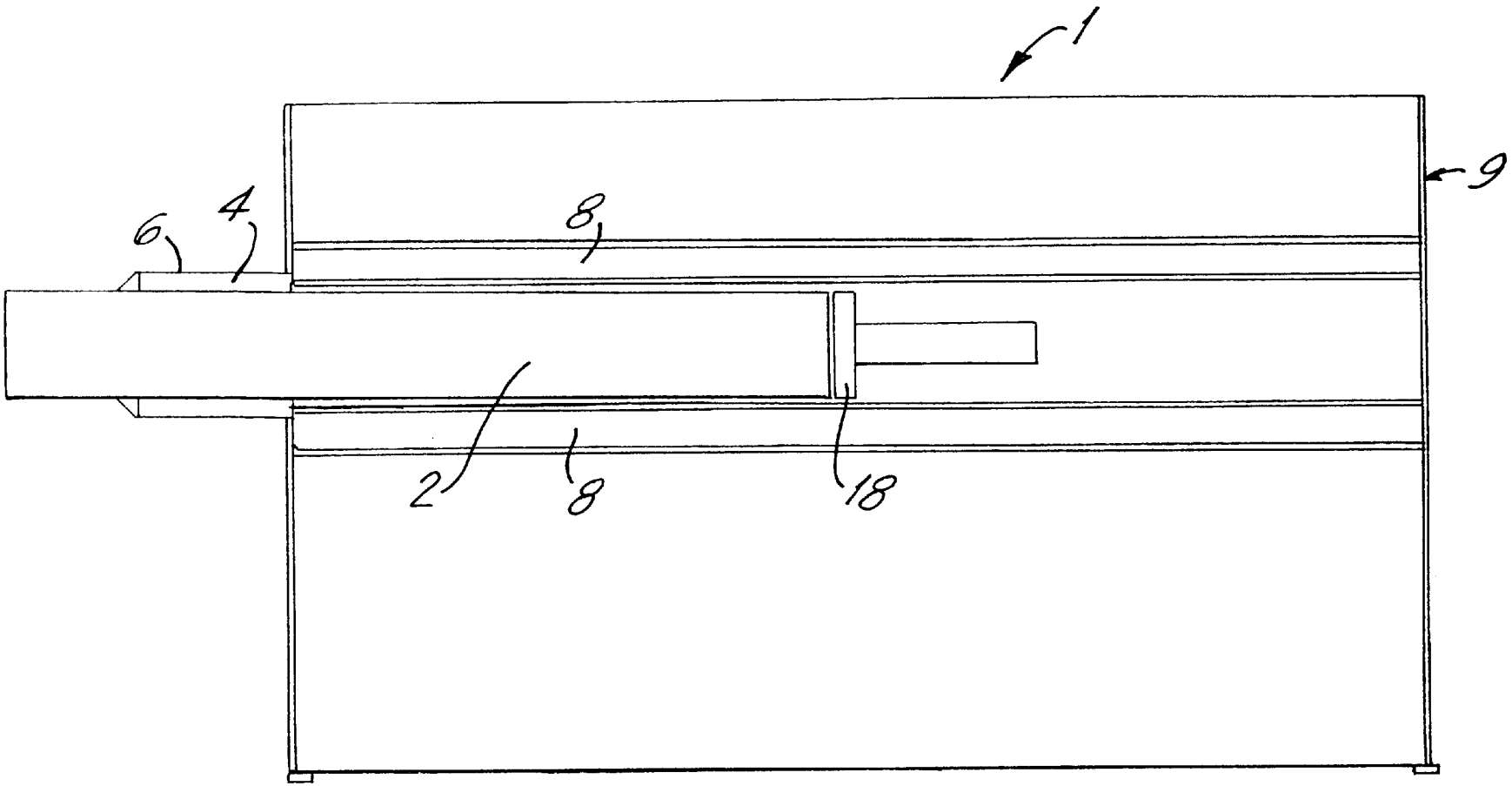

FIG. 3 illustrates the device (1), object of the present invention, from the same position, with the thrust plate (18) in action expelling the mattress (2) from the furling drum (3) into the forming tube (4), with the wrapping (6) being slipped over the far end of the forming tube (4).

Figure 4:
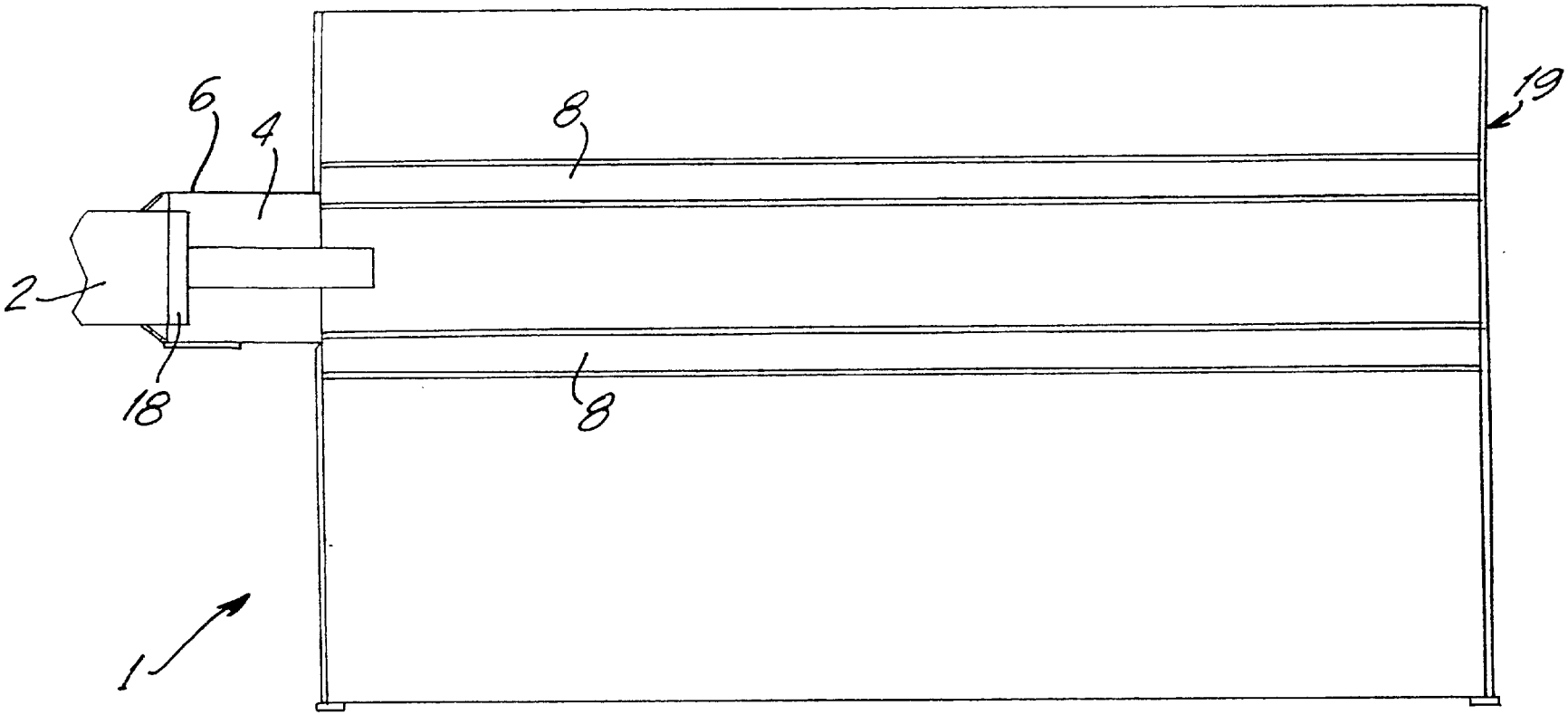

FIG. 4 illustrates the device (1), object of the present invention, again from the same position as that shown in FIGS. 2 and 3, with the thrust plate (18) being in the final position, i.e. the position it assumes right after the finished mattress roll (2) was expelled.

Figure 5:
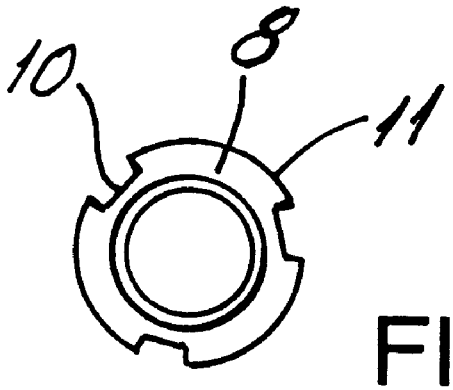
FIGS. 5–7 provide some embodiments of the roller with sectional pattern that is frictionally neutral in the axial expulsion direction.

FIG. 5 shows a given embodiment of the roller (8), wherein the sectional pattern (10) is defined by a number of grooves applied to the roller surface (11), said sectional pattern representing a means of frictional connection with regard to the rotational movement of the mattress. On the other hand, this particular pattern enables a sliding movement of axial expulsion of the mattress (2) as it passes along the rollers (8), and over the recessed sectional pattern (10) respectively, without there being any frictional connection preventing it from being discharged in an axial direction.

Figure 6:
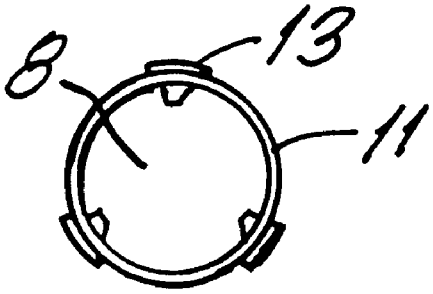
Figure 7:
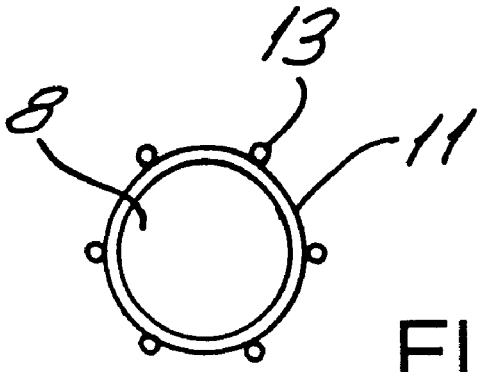

FIG. 6 illustrates a preferred variant of the embodiment shown in FIG. 5, wherein the means used to provide a locking bond, or a sectional pattern respectively, are defined by raised webs (13), as represented again for another preferred embodiment in FIG. 7. The sectional pattern (10), or the raised webs (13) respectively, are either inset in the roller surface (11) or provided by separate elements pasted on, or by any other means attached to, it.

Figure 8:
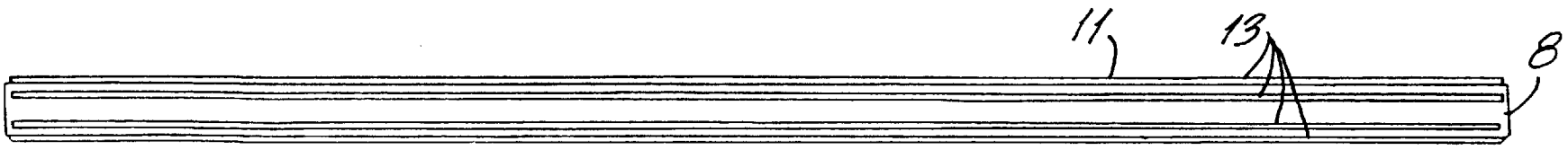
FIG. 8 is a top view of the roller shown in FIG. 7.

FIG. 8 shows a longitudinal view of a roller (8) as represented in FIG. 7, wherein the same elements are identified by the same reference numbers and wherein the webs (13) are distributed radially on the roller (8).

Figure 9:
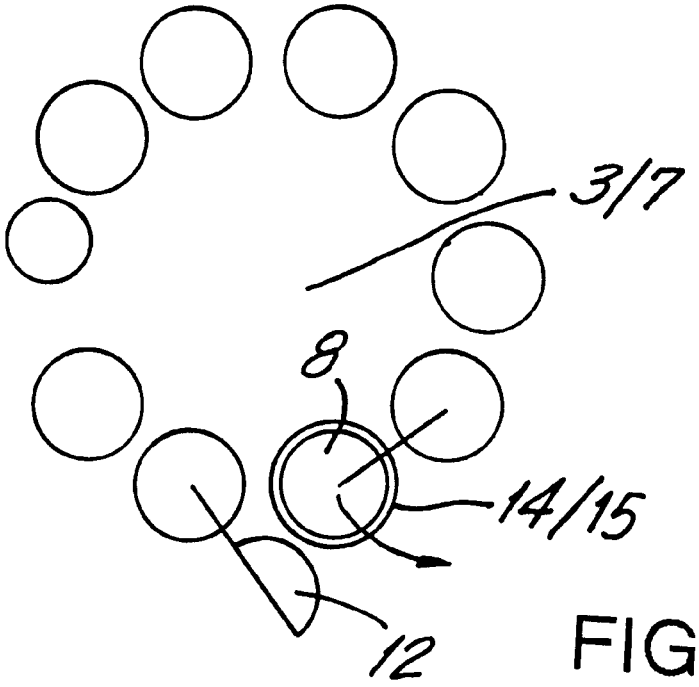
FIGS. 9–11 show different positions of a roller with a nonskid surface (14) that can be swiveled in a disengaged position.
Figure 10:
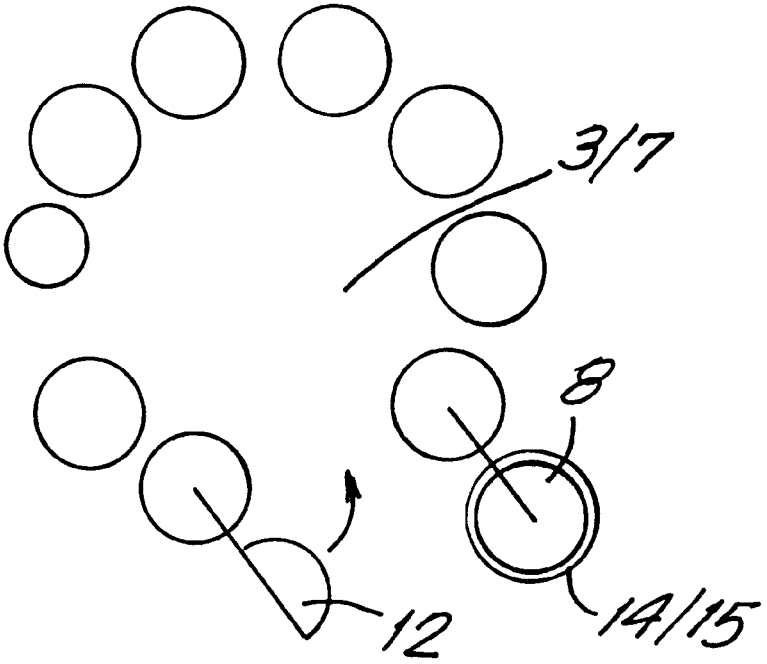
Figure 11:
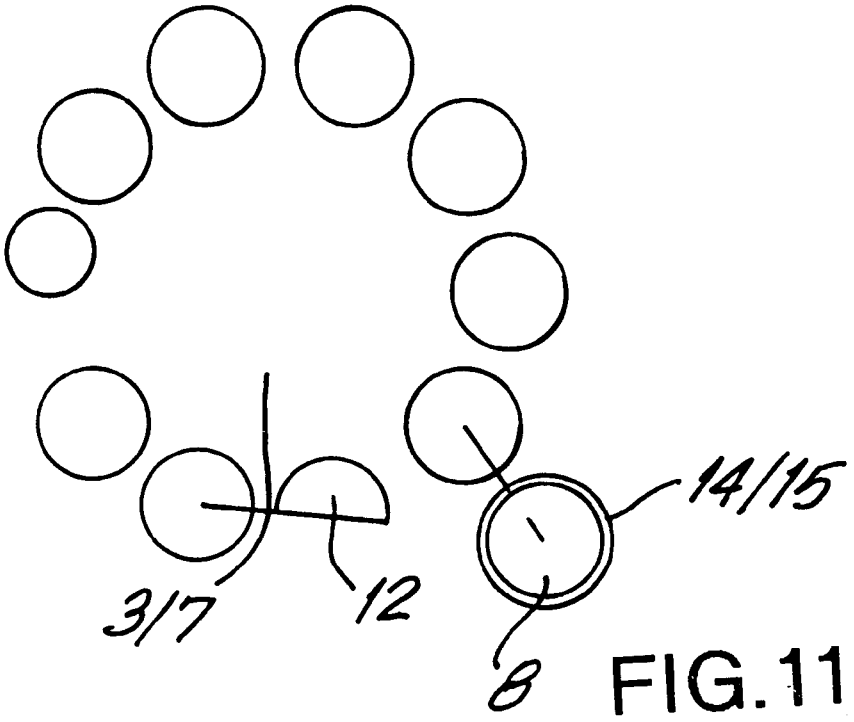

FIGS. 9–11 illustrate another embodiment of the furling drum (3) defined by several rollers arranged in a circular configuration, with all of said rollers having a frictionally neutral surface. A particular feature of the furling drum (3) illustrated in FIGS. 9–11, wherein the mattress feeding means are by the way not shown in detail, consists in that one particular roller (8) out of the circular configuration of several rollers, unlike the other rollers, has a nonskid coating a rubber coating (14) or a roughened surface (15) both in the radial and in the axial direction. This particular roller (8), with a view to not impeding the axial expulsion of the mattress, can be swiveled, out of its engaged position within the circular roller configuration, into a disengaged position, with regard to the mattress, each time the expulsion process is to be released. To prevent the compressed mattress from expanding, a shape-preserving element (12)) is inserted in the position previously occupied by the swung-out roller (8). This process is illustrated in FIGS. 9–11. FIG. 9 shows the position of the roller (8) in which it has entered into a frictional connection with the mattress both in the axial and in the radial direction permitting rotation of the mattress. FIG. 10 shows said roller (8) in its disengaged, or swung-out, position and FIG. 11 the situation with the shape-preserving element (12) engaged, thus assuming the position previously occupied by the roller (8).

Figure 12:
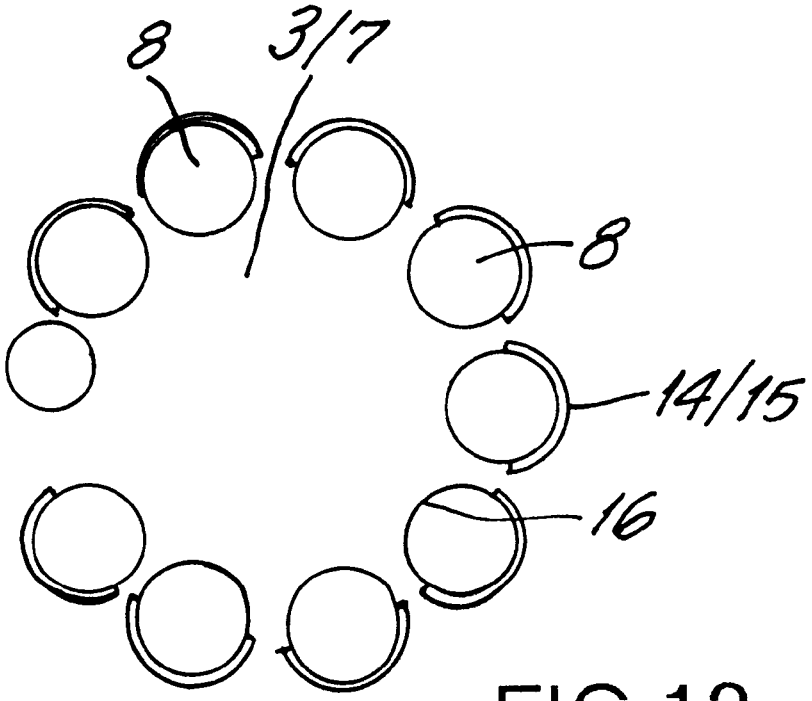
FIG. 12 provide a view of rollers having a partly nonskid surface (14) the frictionally neutral sectors of which, for the purpose of axial mattress expulsion, point at the mattress.

FIG. 12 illustrates another embodiment of the present invention, wherein only a given portion of the surface (11), i.e. the circumference, of the rollers (8) defining the furling drum (3) is equipped with a sectional pattern (10), a rubber coating (14) or a roughened surface (15), in such a way as to form a sector (16) providing a frictionally neutral behaviour.

In this particular configuration covered by the present invention, the rollers (8) can be controlled in such a way as to enable the rotation and compression processes to be effected by having the nonskid sector of at least one roller (8) at a time act upon the mattress, whereas, when it comes to expel the mattress, the rollers (8) can be controlled in such a way as to have their frictionally neutral sectors (16), rather than their nonskid sector, point at, and act upon, the mattress.

We claim:

1. An apparatus for packaging mattresses, comprising:

a furling drum for forming the mattresses into rolls and including a roll-forming chamber defined by a plurality of circumferentially arranged rotatable rollers located downstream of a substantially nozzle-shaped feeding area of the drum, the rollers having a surface pattern defined by a plurality of circumferentially spaced from each other mattress-engaging elements providing for rolling of a mattress into a roll and enabling movement of the mattress in an axial direction; and a forming tube provided downstream of the furling drum for wrapping the roller mattress, the forming tube having a diameter greater than a diameter of the furling drum.

2. An apparatus according to claim 1, wherein the mattress-engaging elements comprise a plurality of circumferentially spaced webs extending at least along a portion of a longitudinal extend of respective rollers.

3. An apparatus according to claim 2, wherein the webs have one of a substantially rectangular cross-section and a substantially circular cross-section.

4. An apparatus according to claim 2, wherein the webs have a square cross-section.

5. An apparatus according to claim 1, wherein the surface pattern comprises a plurality of circumferential surface portions of a roller separated by grooves.

6. An apparatus according to claim 1, wherein the surface pattern is defined by a roughened surface.

7. An apparatus according to claim 1, wherein the surface pattern comprises a rubber coating.

8. An apparatus according to claim 1, wherein the surface pattern provides for frictional engagement of the rollers with the mattresses.

9. An apparatus according to claim 8, wherein the rollers are formed as tiltable rollers movable between position, in which they engage the mattress, and a position in which they are disengaged from the mattress.

* * * * *